United States Patent [19]

Van Exel

[11] 4,283,872

[45] Aug. 18, 1981

[54] ADJUSTABLE DISPLAY DEVICE

[76] Inventor: Gerrit A. Van Exel, 2300 Camino Escondido, Fullerton, Calif. 92633

[21] Appl. No.: 874,030

[22] Filed: Jan. 31, 1978

[51] Int. Cl.[3] ..... G09F 11/00

[52] U.S. Cl. ..... 40/491

[58] Field of Search ..... 40/491, 495, 113, 109, 40/490; 235/88, 78, 70

[56] References Cited

U.S. PATENT DOCUMENTS

| | | | |
|---|---|---|---|
| 2,005,191 | 6/1935 | Koski | 40/491 |
| 3,468,037 | 9/1969 | Warneke | 235/88 X |
| 3,471,956 | 10/1969 | Walters | 40/495 |
| 4,008,533 | 2/1977 | Greenberger | 40/495 |

FOREIGN PATENT DOCUMENTS

| | | | |
|---|---|---|---|
| 380249 | 9/1932 | United Kingdom | 40/109 |

*Primary Examiner*—Gene Mancene
*Assistant Examiner*—Wenceslao J. Contreras

[57] ABSTRACT

An adjustable display device consisting of two or more members, for displaying relevant information when these members have been moved in specific relationships to each other. Both the relative movement and the maintenance of the specific relationships are accomplished by cuts through the thickness of one member to form integral tabs in that member to retain and guide the other member(s).

5 Claims, 12 Drawing Figures

ADJUSTABLE DISPLAY DEVICE

SUMMARY OF THE INVENTION

The invention relates to a device that is able to display a multitude of information in a concise form by changing positions of one or more members in relation to another member, such as is found in slide charts, greeting cards and the like. In particular, the invention relates to the method of retaining, guiding and moving the members in relation to each other.

The invention generally applies, but is not restricted, to information in the form of scales, numbers, pictures, etc. printed on two or more pieces of paper, cardboard, plastic, or other similar material. The change of the relative position of the members is generally accomplished by sliding or rotating one moveable member in relation to a fixed member while being guided by tabs forming an integral part of this fixed member. These same tabs also retain the moveable member in close relationship to the fixed member, both during the movement and during the display of the resulting information.

In one form this device consists of a linearly moveable member and a fixed retaining member. In another form it consists of a rotatably moveable member and a fixed retaining member. In yet another form it consists of a combination of linearly and rotatably moveable members retained in separate or included fixed members. The invention is intended for use in the field in which conventional slide charts are used, and additionally in fields whereever variations of this invention find application, such as games, puzzles, novelties, greeting cards, etc.

The prior art, in the form of slide charts and moveable cards, is generally designed in such a manner that the moveable part, whether a slide or a rotating disc, is held in relation to the stationary part by means of additional parts or processes. For instance, a linear slide is commonly held in place in the frame by means of riveted or glued-in guides, which have to be carefully aligned to assure that the slide fit is not too tight nor too loose. The fixed member (only) has openings through which information contained on the moveable member can be seen. A rotating disc is commonly held in place in the frame by means of a central pivot rivet, allowing for free rotation of the disc, if the riveting is done carefully, otherwise the disc may be hard to rotate. Furthermore, the conventional rotating disc is permanently riveted to the frame, not allowing for addition or substitution of parts, either for expanding the scope of the device or for repair. Not only do these constructions necessitate additional expense in parts, labor and equipment, and do they add bulk to the items, but they also require that relatively heavy basic materials be used for display surfaces, adding further to the cost of these items.

My invention overcomes these disadvantages in that the moveable members are held in relationship to the stationary members by means of cuts through the thickness of these members, thereby forming retaining and guiding tabs for the moveable members. No additional parts or operations are required. This invention also allows the use of much thinner and therefore less expensive basic materials. In addition, my invention allows the product to be designed and produced in such a manner that both the moveable member and the fixed member are formed in one sheet and can readily be assembled into its final usable format by the ultimate consumer, thus eliminating costly assembly time and/or equipment. The assembly of the members to form the device is a simple matter of slipping one member under the retaining tabs in the other member.

The display device according to my invention can therefore be produced much less expensively as it does away with extra parts, equipment and labor. It could even be produced without any additional expense if it is printed and die-cut as part of a product package which generally already has printing and die-cutting included in its design. Another embodiment of my invention allows for the easy assembly of the moveable member onto the fixed member, yet resulting in a device in which the movement of the moveable member is restricted to a predetermined amount, which can include prevention of disengagement during normal use.

It is an object of this invention to provide an adjustable display device, wherein the moveable member is easily and simply attached to, and retained and guided by the fixed member by means of tabs, forming an integral part of this fixed member.

Another object of my invention is to achieve the foregoing object by means of simple printing and die-cutting of both members on a single sheet, if necessary without punching any complete openings which may cause waste material to jam up equipment and machinery and reduce the strength of the device.

A further object of my invention is to provide an adjustable display device in which the moveable member can easily be attached to and detached from the fixed member, yet during normal adjustment the travel is restricted by a built-in stop which can also serve to prevent disengagement of the members.

Still another object of my invention is to provide an adjustable display device in which the moveable member can be rotated in relation to the fixed member, without obstructing the center of rotation of the moveable members by a rivet or other pivoting device.

Yet another object of my invention is to provide an adjustable display device consisting of more than two members, all but one of which are moveable in relation to at least one other member (either fixed or moveable) and which are easily and simply attached to and guided by that member by means of tabs forming an integral part of that member and resulting in a large number of combinations of information contained in a small package.

A further object of my invention is to provide a linearly adjustable display device with openings in fixed or moveable members or both for viewing displayed information.

Several embodiments of the invention are shown in the accompanying drawings, however it should be noted that these illustrations are not intended to show every possible configurations.

DESCRIPTION OF THE PREFERRED EMBODIMENT

Figure 1:
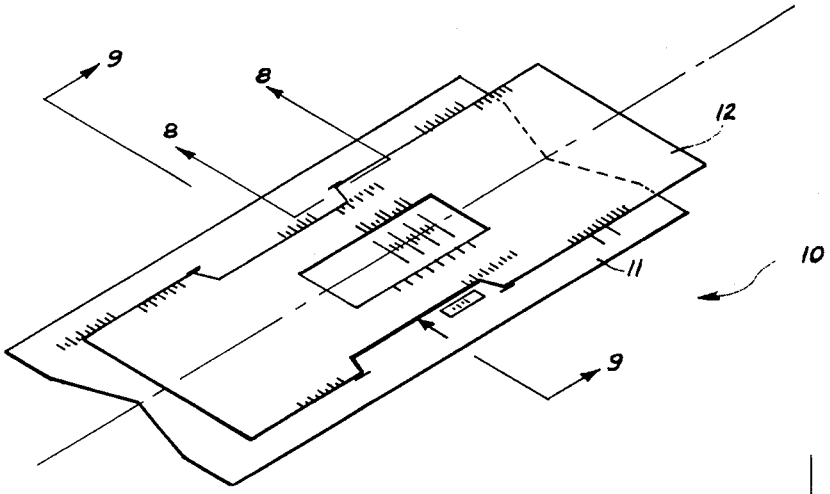
FIG. 1 is a perspective view of a linearly adjustable display device according to the invention.

FIG. 1 shows a display device 10 according to the invention, consisting of an assembly of two members: a fixed member 11 and a moveable member 12. These members can be made of any suitable thin material, such as paper, cardboard, plastic. A preferred and inexpensive embodiment uses a paperboard material, such as a 120# Bristol board.

Figure 2:
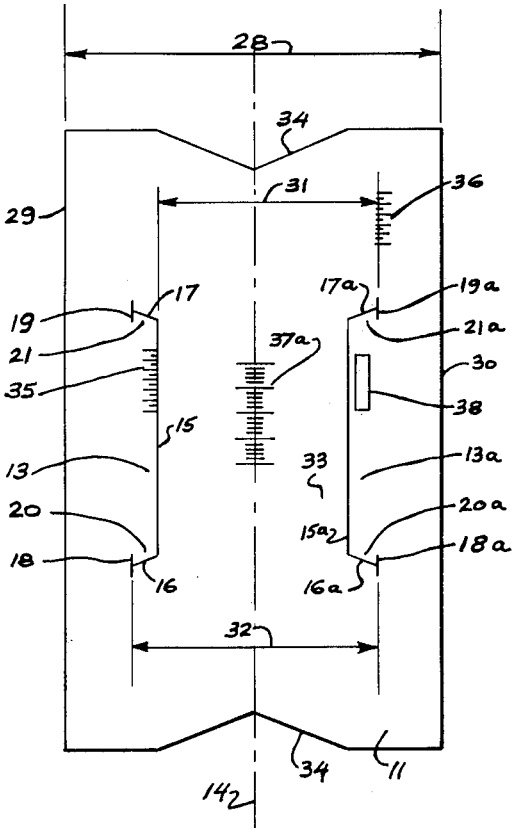
FIG. 2 is a plan view of the fixed member of FIG. 1.

FIG. 2 shows fixed member 11 in plan view. It has two tabs 13 and 13*a*, which are partially cut-out areas. Tab 13 is located on one side of the longitudinal centerline 14 and is defined by a long, straight, cut line 15 and two short cut lines 16 and 17, connected to and at an angle to line 15. Line 15 is approximately parallel to centerline 14 and about a third of the length of the member 11. Additional short cut lines 18 and 19 are provided at the opposite ends of lines 16 and 17 and are essential parallel to line 15, thereby forming tab ends 20 and 21. Tab 13*a* is located on the other side of and about equal distance from the centerline 14 and is defined by cut lines 15*a* and through 19*a*, similar to cut lines 15 through 19, to form basically a mirror image of tab 13.

Figure 3:
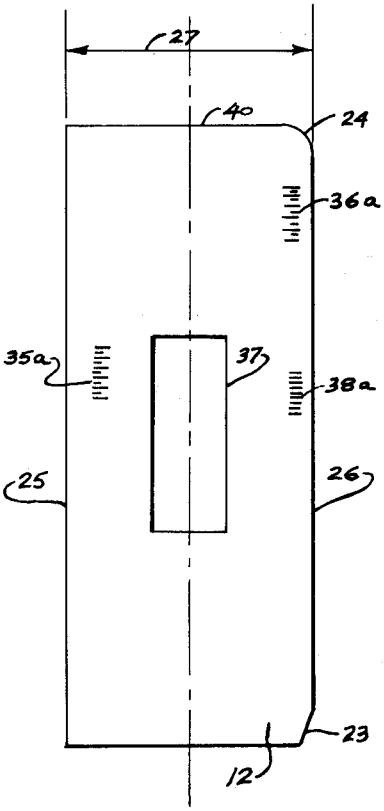
FIG. 3 is a plan view of the moveable member of FIG. 1.

FIG. 3 shows a plan view of the moveable member 12. It has two straight and parallel edges 25 and 26, which define the width 27 of this member. This width is smaller than the width 28 of member 11 as defined by its edges 29 and 30. This latter width 28 is not critical. However, the width 27 of moveable member 12 is important and determines the location of the tabs 13 and 13*a* in fixed member 11. In order to retain the moveable member 12, the distance 31, between line 15 of tab 13 and lines 18*a* and 19*a* of tab 13*a*, must be less than the width 27 of member 12. A similar relationship must exist between line 15*a* of tab 13*a* and lines 18 and 19 of tab 13. In addition, the distance 32 between parallel lines 18 and 18*a* and between 19 and 19*a* must be equal to, or slightly larger than, the width 27 of the moveable member 12, in order to properly guide this member.

Figure 9:
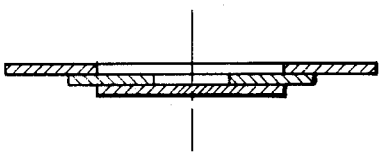
FIG. 9 is a section on line 9—9 of FIG. 1.
Figure 8:
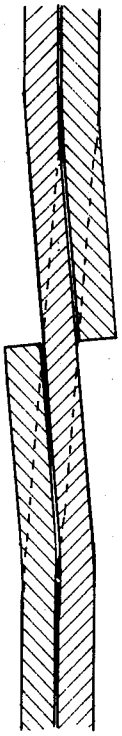
FIG. 8 is a section on line 8—8 of FIG. 1.
Figure 12:
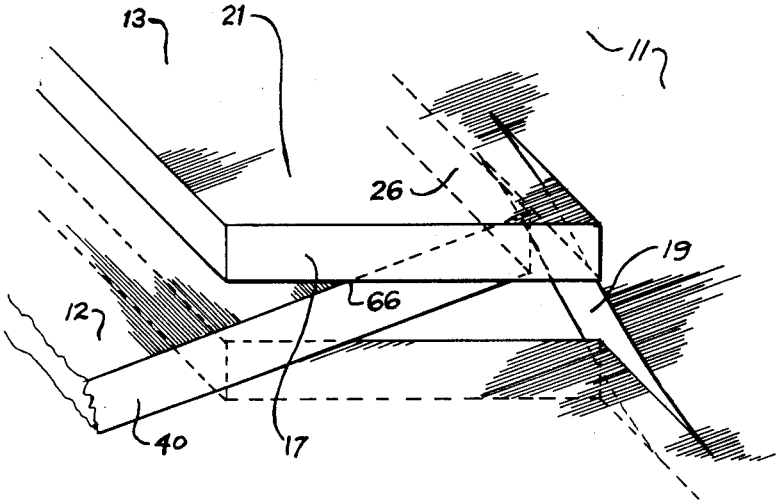
FIG. 12 is a perspective view of a retaining and guiding means of the device.

For the display device to be useful, it is assembled as shown in FIGS. 1 and 9. This can be accomplished by lifting tabs 13 and 13*a* slightly and slipping the edges 25 and 26 of the moveable member 12 under the tabs. When the tabs are now released, member 12 is retained between the tabs and the central section 33 of the fixed member 11. Member 12 can now be moved longitudinally with respect to member 11, parallel to centerline 14. Tabs 13 and 13*a* retain the moveable member, while tab ends 20, 21, 20*a* and 21*a* bend out of the way to expose edges of cuts 18, 19, 18*a* and 19*a*. These edges, as shown in FIGS. 8 and 12, provide surfaces by which the sides of edges 25 and 26 of the moveable member are guided. In this embodiment the guide cuts 19, etc. extend on either side of the end of the transverse cuts 17, etc. However other shapes, either straight or curved, can also be used for this purpose.

Finger cut-outs 34 can be provided on member 11 to facilitate grasping member 12 when it is in the center position of its travel.

Both members 11 and 12 have information contained on them which will become meaningful when member 12 is moved in relation to member 11 to one of many positions, depending on the type of information contained. The type of information and the method to make best use of this, are well known in existing types of slide charts and is not the subject of this invention. For instance, information can be provided in the form of scales, numbers, descriptions, pictures, etc. on either fixed or moveable member, in such locations as 35, 35*a*, 36 or 36*a* along the edge of one or both members, or 37, 37*a*, 38, and 38*a* through openings in one or both members.

Further improvements in the construction of this device are shown in the preferred embodiment: FIG. 3 shows the two corners 23 and 24 of edge 26 slightly modified: 23 is tapered, 24 rounded. Both designs allow for easier re-engagement of the moveable member with the four guide edges 18, 19, 18*a* and 19*a*, if it has accidentally become disengaged from two of them. All four corners could be tapered or rounded but two is sufficient for the purpose, leaving the opposite edge 26 straight for full attachment to edge 30 of member 11, if the total device is to be printed and die-cut from one sheet.

Figure 10:
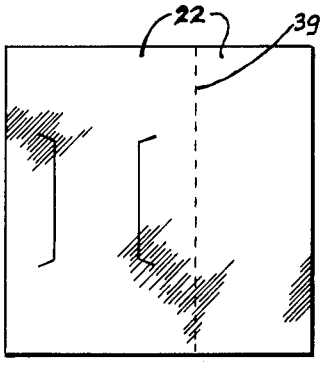
FIG. 10 is a plan view of a single sheet of material to produce a linearly adjustable display device according to the invention.

FIG. 10 shows a plan view of the single sheet of material 22 when used to produce both members of the device in one printing and one die-cutting operation. In this manner of production, the two members are attached to each other at line 39 which is a line of least resistance to tearing (such as a perforated or scored line). This allows the single sheet to be produced, stacked, stored and handled without projections or bulges such as those formed by rivet heads, and without the need for assembly, which can now be done upon receipt by the ultimate consumer.

FIG. 2 shows the connecting lines 16, 17, 16*a* and 17*a* cut to intersect the parallel lines 15 and 15*a* in such a way that the resulting angles at both ends of the tabs are greater than 90°. This also facilitates re-engagement of the moveable member if it has accidentally become partly disengaged. In this embodiment, as shown in FIG. 12, the end edge 40 of the moveable member 12 is no longer parallel to cut line 17. If edge 40 now slips past line 17 under tab 13, reversing the movement of member 12 will gradually move the contact point 66 of edge 40 with cut line 17 along one edge of this cut line 17, starting with the corner closest to the centerline and moving towards the outside until edge 40 has totally passed line 17 and moveable member 12 is once again guided by the edge of line 19.

Figure 4:
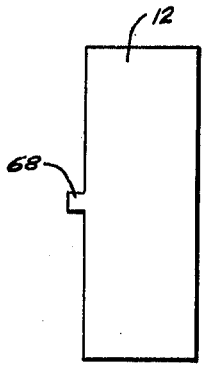
FIGS. 4 and 5 are plan views of moveable members showing variations of a built-in stop device.
Figure 5:
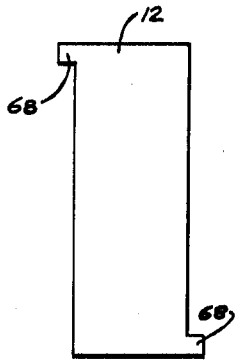
Figure 6:
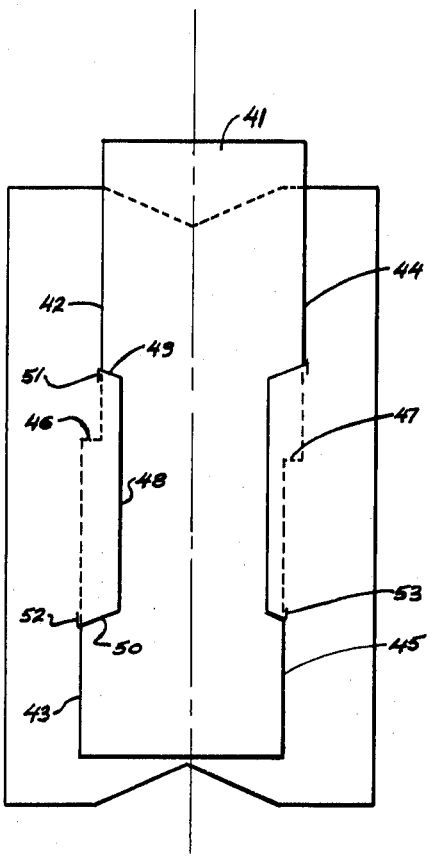
FIG. 6 is a plan view of a linearly adjustable display device with a built-in stop.

Another version of the display device has the moveable member equipped with a built-in stop. This allows this member to still be inserted in the fixed member in the standard manner as described before by slipping it between the tabs and the central portion of the fixed member. However, once installed in this way, the movement of the moveable member during normal operation is restricted to a length which is predetermined by the stop which is part of this member. This stop can have different forms, some of which are shown in FIGS. 4, 5 and 6. The operation of the stopping action of the members shown in FIGS. 4 and 5 becomes clear when looking at the illustrations which show two versions of a linearly moveable member 12 with built-in stop 68 and are designed to work in cooperation with the standard fixed member and tabs as described earlier.

FIGS. 4 and 5 also illustrate clearly that the edges of the linearly moveable member do not need to be uninterrupted straight lines, but can have any contour, provided certain sections of this member have edges which are straight and parallel to the direction of movement.

The embodiment with the stopping action as shown in FIG. 6 requires different tab configurations and is therefore described in more detail:

In this embodiment the guided sides of the moveable member 41 have two edges each: 42, 43, 44 and 45, which are parallel to each other and to the direction of movement of the member, but slightly offset from each other, forming a step 46 and 47 respectively. The shape of the tabs in the fixed member is such that it accomodates the guiding of the stepped moveable member. For instance, looking at the left tab in FIG. 6, the long cut line 48 is essentially the same as described before, but the two connecting cut lines 49 and 50 are of different length ending in cut lines 51 and 52 in locations that provide proper guidance for the two edges 42 and 43 of the movement member. When member 41 is moved in an upward direction, the end of cut guide line 51 will eventually interfere with step 46, preventing further movement in that direction. A similar guiding and stopping action is provided on the opposite edge of member 41 when the end of cut guide line 53 will interfere with step 47 when member 41 moves in the downward direction. In this type of embodiment the steps can be placed in any location to form any desired length of movement of member 41. It is of course desirable to locate the steps such that, when one step causes the moveable member to stop, the opposite step is still covered by its retaining tab. Although the movement of member 41 is restricted during normal operation, the installation of this member is still a simple matter of lifting the tabs slightly and slipping the edges of the member under the tabs.

Other variations of combinations of shapes and locations of edges of the moveable member and tabs in the fixed member are of course possible and will readily come to mind.

Figure 7:
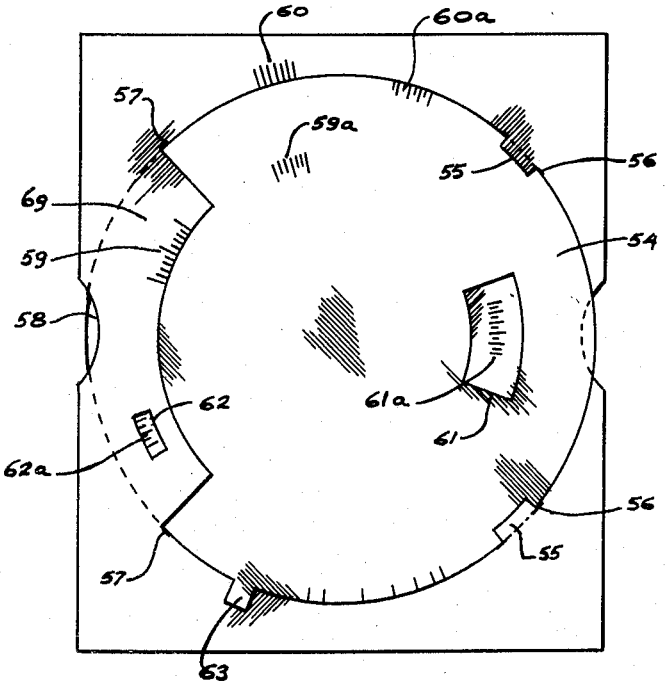
FIG. 7 is a plan view of a rotatably adjustable display device according to the invention.

FIG. 7 shows an embodiment whereby the moveable member 54 is in the form of a disc and the movement of this member is rotational rather than linear. In other areas, the similarities with the previously described version can be noticed: the moveable member 54 is retained by tabs such as 55 and 69 and guided by the edges of short cut lines 56 and 57, which are located in a tangentional direction. The grasping of the disc is facilitated by finger cut-outs 58. Both fixed and moveable members can again be provided with information that can be aligned at the edges (59, 59*a*, 60 and 60*a*) or through openings in either member (61, 61*a*, 62 and 62*a*). Although the disc does not disengage during normal movement, a stop can again be provided to limit the movement of the disc. A projection 63 on the disc is one way to accomplish this. Variations on the design will suggest themselves. The installation of the moveable member under the tabs of the fixed member is done in the same manner as in the linear device, i.e. by lifting the tabs slightly and slipping the edges of the moveable member under the tabs.

It is clear that the center of the moveable member is unobstructed and can therefore also be used for display of information.

The usefulness of both the linear version and the rotational version can be further extended by adding more moveable members. For instance, in the combination described before, member 11 is the fixed member, whereas member 12 is retained and guided by tabs in member 11. Member 12 can in turn have tabs to retain and guide another member that is moveable relative to member 12. Member 12 is then therefore both a moveable member (relative to member 11) and a fixed member. This principle can be extended further, can be applied to the rotational version or can be used in a combination of linear and rotational versions. The possibilities are limited only by practical size considerations.

The tabs have thus far been described as being integral parts of the fixed member. This has been found to be the most practical embodiment, but they can also be located in the moveable member or in both members.

Figure 11:
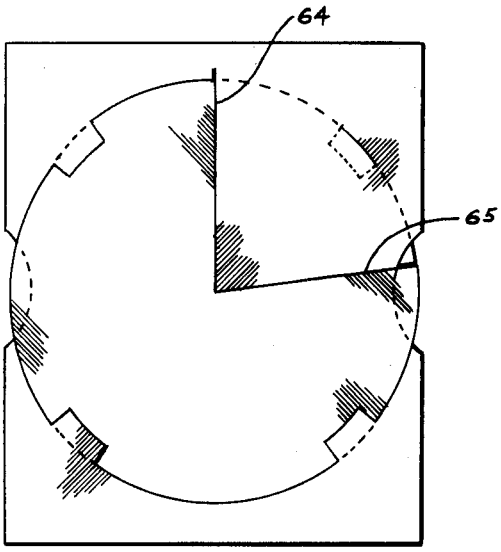
FIG. 11 is a plan view of an alternative rotationally adjustable display device according to the invention.

FIG. 11 shows a rotational embodiment in which the elimination of the central pivot point has been utilized to make a display device whereby the moveable member is partly in front of the fixed member and partly behind, depending on the amount of rotation of the moveable member. This is accomplished by means of a slit 64 in the fixed member, extending from the center out to a distance at least as far as the radius of the moveable member and a slit 65 in the moveable member, extending from the center to the edge. By slipping one of the slit edges of the moveable member under the slit in the fixed member, part of the moveable member will disappear behind the fixed member. As the integral tabs in the fixed member can bend out either forward or backward, they will still serve to guide the edge of the moveable member whether in front or behind the fixed member. This "disappearing" or "appearing" feature is useful in certain design requirements, such as displaying "elapsed" or "remaining" information or when certain sections of scales are not allowed to overlap. A similar feature can be visualized using a linear version of this display device and will not be described further.

In a preferred embodiment of the basic linear type described earlier, the two members of the device are printed on one sheet of stiff paper, with the appropriate die-cutting made such that the retaining tabs in the fixed member and the perforation line between the fixed and moveable member are cut or formed simultaneously. In this form, one part only needs to be produced and handled until it reaches the ultimate customer, who then assembles the working device by tearing off the moveable part at the perforations, inserts one side of it under the appropriate tab in the fixed part and the other side under the opposite tab. By holding the fixed member with one hand and grasping the end of the moveable member with the other hand, the two members can be moved relative to each other as one is retained and guided by the tabs in the other. The position(s) to which the members have to be moved in relationship to each other to obtain meaningful information will depend on the basic information contained on each of the members.

In the rotational type, the two members can also be printed on and die-cut in one sheet, similar to the linear type. But in this case the moveable member is in the shape of a disc and must be pushed out of the sheet leaving some wasted material. One side of the disc is now slipped under one or more tabs, then the other side is engaged under the last tab by slightly bending the tab and/or the disc. With the disc retained and guided by the tabs, one hand holds the fixed member, the other hand grasps the projection of the moveable member at the finger cut-out area provided for that purpose in the fixed member and, by applying a force to the moveable member in the tangentional direction, this part can be rotated as it is guided by the tabs. The final position of the two members will again depend on the information contained thereon.

There has been described a novel adjustable display device that can be produced by a simple printing and die-cutting step to form two (or more) members on a single sheet, eliminating separate fasteners, "built-up" laminated parts, and assembly time and equipment, whereby the moveable member can be readily assembled to the fixed member by the end user and is firmly retained and guided by tabs integral with the fixed member yet allowing the easy substitution of alternate members.

What is claimed is:

1. An adjustable display device, comprising two members which are linearly moveable in relation to each other, and a retaining means to retain and guide the first member in relation to the second member, the retaining means being an integral part of the second member and formed by cutting through the thickness of said member, forming a tab which allows displacement of part of said member to retain and guide the peripheral edge of the first member the tab being defined by a first cut, essentially parallel to the direction of movement of the moveable member, and by a second and third cut on either end of the first cut, said second and third cuts being transverse, extending away from the centerline, and of unequal length, such that the ends of these cuts form guides, which are displaced from each other in the direction perpendicular to the direction of movement by an amount equal to, and in the same direction of, the offset in the guided peripheral edge of the moveable member.

2. The device defined in claim 1, wherein two tabs are used in spaced relationship to each other, such that the unequal cuts and the offsets in the peripheral edges act to form the opposite limits of travel of the moveable member.

3. An adjustable display device, comprising two members, moveable in relation to each other, and a retaining means, to retain and guide the moveable member in relation to the fixed member, said means comprising two tabs, forming an integral part of the fixed member, by cutting through the thickness of said member, said tabs being formed by two cuts:

(a) a central cut, defining that portion of the tabs that serve to retain the moveable member, (b) an end cut, parallel to the direction of local movement of the moveable member, said cut, upon displacement of the tabs for retention of the moveable member, discloses an edge in the fixed member, said edge being parallel to the local movement of the moveable member and serving to guide said member.

4. An adjustable display device, comprising two members which are linearly moveable in relation to each other, and a retaining means to retain and guide the first member in relation to the second member, the retaining means being an integral part of the second member and formed by cutting through the tickness of said member, forming a tab which allows displacement of part of said member to retain and guide the peripheral edge of the first member, said tab having a first cut parallel to the direction of movement of the moveable member and a second cut, extending from the forward end of the first cut, in a direction away from the centerline, said direction being non-parallel to that part of the non-guided forward edge of the moveable member that passes under said second cut when said member is retained and guided by said tab.

5. An adjustable display device, comprising two members which are moveable in relation to each other, and a retaining means to retain and guide the moveable member in relation to the fixed member, the retaining means being an integral part of the fixed member and formed by cutting through the thickness of said member, forming two tabs by means of three cuts:

(a) first cuts parallel to the direction of the movement of the moveable member, (b) second cuts, extending from one end of the first cuts in a direction away from each other and of a length such that the free ends of said cuts are located at a distance equal to, or slightly larger than, the guided width of the moveable member, (c) third cuts, similar to the second cuts, but extending from the opposite end of the first cuts, said guided width of the moveable member having two parallel smooth edges, one of which is interrupted by a local projection such that the width of the moveable member is locally increased sufficiently to inhibit the free movement of the moveable member when the location of said projection on the moveable member coincides with the location of the free ends of the second or third cuts on the fixed member.

* * * * *